US005662836A

United States Patent [19]

Yost

[11] Patent Number: 5,662,836

[45] Date of Patent: Sep. 2, 1997

[54] FUEL JET HAVING STEPPED NEEDLE

[76] Inventor: Robert M. Yost, 10838 Olive St., NW., Coon Rapids, Minn. 55448

[21] Appl. No.: 547,843

[22] Filed: Oct. 25, 1995

[51] Int. Cl.[6] ..... F02M 9/06

[52] U.S. Cl. ..... 261/44.3; 261/DIG. 38

[58] Field of Search ..... 261/44.3, 44.4, 261/DIG. 38

[56] References Cited

U.S. PATENT DOCUMENTS

| | | | |
|---|---|---|---|
| 2,786,658 | 3/1957 | Duriez | 261/44.3 |
| 3,198,498 | 8/1965 | Mennesson | 261/44.4 |
| 3,456,929 | 7/1969 | Lawrence | 261/44.4 |
| 3,829,069 | 8/1974 | Hailstone et al. | 261/44.3 |
| 4,137,284 | 1/1979 | Barbee | 261/44.3 |
| 4,141,940 | 2/1979 | Dye | 261/44.3 |
| 4,460,518 | 7/1984 | Teramura et al. | 261/44.4 |
| 4,465,642 | 8/1984 | Nakamura et al. | 261/44.4 |

FOREIGN PATENT DOCUMENTS

| | | | |
|---|---|---|---|
| 3-210056 | 9/1991 | Japan | 261/44.3 |
| 152442 | 10/1920 | United Kingdom | 261/44.3 |

OTHER PUBLICATIONS

Installation Instructions for Yost Power Tube, Yost Performance Products, P.O. Box 33408, Minneapolis, MN 55433.

*Primary Examiner*—Tim R. Miles
*Attorney, Agent, or Firm*—James W. Miller

[57] ABSTRACT

A carburetor includes a main fuel jet having a reciprocal needle received therein for controlling fuel as such fuel flows into an air flow passage of the carburetor. The needle includes a stepped portion which is integrally formed or rigidly affixed thereto. The stepped portion is located along the length of the needle such that is located within the fuel jet in the minimum fuel flow position of the needle. This stepped portion prevents unwanted fuel from wicking or traveling up along the length of the needle when the needle is in its minimum fuel flow position and fuel flow through the fuel jet is to be at its minimum value.

14 Claims, 2 Drawing Sheets

FUEL JET HAVING STEPPED NEEDLE

TECHNICAL FIELD

This invention relates to a fuel jet for supplying fuel to an air flow passage where such fuel is mixed with air to form an air/fuel mixture prior to such mixture being admitted to a combustion chamber of an internal combustion engine. More particularly, this invention relates to a fuel jet having a flow controlling needle reciprocally mounted in the fuel jet.

BACKGROUND OF THE INVENTION

Fuel jets are known for supplying fuel to the air flow passage of a carburetor or similar device where such fuel is mixed with air to form a combustible air/fuel mixture. Such jets are usually located in a venturi portion of the air flow passage, upstream of the throttle plate, such that the vacuum produced in the venturi portion helps draw fuel through the jet and into the air flow passage. Some carburetors may have multiple jets located in the air flow passage. For example, a slow jet may be provided for supplying fuel at idle or at low speeds and a main jet may be provided for supplying fuel at midrange or high speeds.

The main fuel jets used in such carburetors often have a flow controlling needle that is reciprocally contained within the fuel flow passage of the fuel jet. The amount of fuel delivered by the fuel jet is controlled by sliding the needle into or out of the fuel jet using an reciprocal slide that is mounted in the carburetor body. The upper end of the needle is connected to the slide such that vertical up and down movement of the slide is translated into vertical up and down movement of the needle. The needle includes a tapered section which creates a bigger gap between the outer diameter of the needle and the fuel flow passage of the fuel jet as the needle rises, thus increasing the fuel flow through the main jet as the needle rises in the main jet.

At idle or low speeds, all or most of the fuel supplied to the engine is supposed to be delivered by the slow jet. No or little fuel is supposed to flow through the main jet at this time. Thus, in the lowest position of the slide corresponding to the maximum insertion of the needle into the main jet, fuel flow should occur through the main jet only at a minimum value, i.e. zero flow or a preselected small flow.

However, the Applicant has discovered that some additional, unwanted fuel will flow up and out of the main jet even at idle or low speeds when fuel flow through the main jet should be at its minimum value. The Applicant has observed this happening with drops of fuel seeming to travel up the back of the needle in a wicking type manner. This fuel then enters the air flow in the air flow passage and overly enriches the air/fuel mixture at idle or at low speeds. This causes the engine to perform less well than it should at such engine operational conditions and can prevent a smooth acceleration from idle or low speed conditions. This is obviously undesirable.

SUMMARY OF THE INVENTION

One aspect of this invention relates to a fuel jet having a flow controlling needle that prevents undesirable fuel from flowing or wicking up along the needle when the needle is in its minimum fuel flow position relative to the fuel jet.

These and other aspects of this invention are provided by a fuel jet for supplying fuel to an air flow passage. The fuel jet has an upper surface and a fuel flow passage that is operatively connected to the air flow passage for conducting fuel from a supply thereof through the fuel jet, past the upper surface of the fuel jet, and into the air flow passage. A flow controlling needle is reciprocally mounted in the fuel flow passage of the fuel jet to control the amount of fuel that flows therein. The flow controlling needle has a minimum fuel flow position which represents a minimum fuel flow condition for the fuel jet. The flow controlling needle can be vertically raised from its minimum fuel flow position relative to the fuel jet to increase the fuel flow through the fuel jet. A stepped portion is provided on the flow controlling needle extending at least partially around the needle's circumference, the stepped portion being positioned on the needle's length such that it is located no higher than the top surface of the fuel jet when the needle is in its minimum fuel flow position.

BRIEF DESCRIPTION OF THE DRAWINGS

The present invention will be described hereafter in the Detailed Description, taken in conjunction with the following drawings, in which like reference numerals refer to like elements or parts throughout.

DETAILED DESCRIPTION

Figure 1:
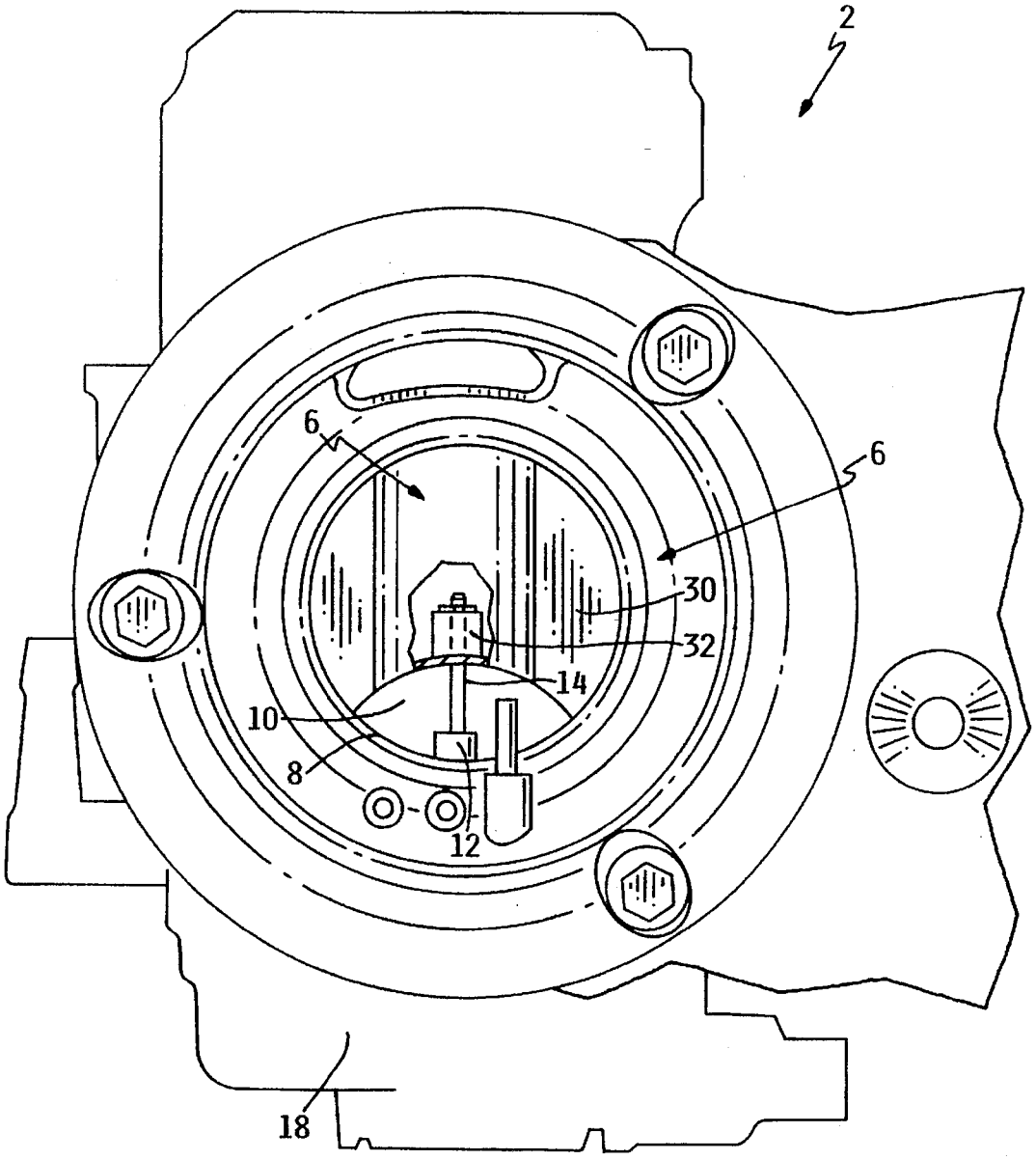
FIG. 1 is a front elevational view of a carburetor showing the air flow passage of the carburetor from the inlet end of the air flow passage, and more particularly illustrating the main fuel jet, the needle received therein, and the slide for vertically moving the needle up and down, a portion of FIG. 1 being broken away to show the attachment of the upper end of the needle to the slide.

Referring first to FIG. 1, a carburetor 2 for use with an internal combustion engine is depicted looking in through the mouth or inlet 4 of carburetor 2 along the air flow passage 6 formed in carburetor 2. Air flow passage 6 has a section of reduced or narrowed diameter with tapered portions on either side thereof forming a venturi 8. The far end of carburetor 2 as seen in FIG. 1 includes a pivotal throttle plate 10 also often known as a butterfly valve. Only the lower portion of throttle plate 10 can be seen in FIG. 1.

The basic purpose of carburetor 2 is to mix air and fuel together in air flow passage 6 to create a combustible air/fuel mixture. This air/fuel mixture flows through air flow passage 6 and is admitted into the intake manifold of the engine whenever throttle plate 10 is at least partially open. To accomplish the admission of fuel into air flow passage 6, one or more fuel jets may be provided for squirting or flowing fuel into the passage. Such jets are often located in venturi 8 of air flow passage 6 so that the vacuum created in venturi 8 by the air flowing therethrough will cause fuel to flow up through the fuel jets and into the passage. This invention relates to an improved main fuel jet 12 having a reciprocal flow controlling needle 14.

Main fuel jet 12 projects upwardly into the bottom of venturi 8 of air flow passage 6. Main fuel jet 12 includes an elongated, generally vertical, fuel flow passage 16 that extends downwardly into the body of carburetor 2. The lower end of fuel flow passage 16 is operatively connected to a source of fuel, such as the fuel contained in a float bowl 18 in the bottom of carburetor 2. As air passes through venturi 8, fuel will be drawn upwardly from the source thereof, through fuel flow passage 16 and through main fuel jet 12 to exit or be dispersed into air flow passage 6. Main fuel jet 12 includes a top surface 20 that is located slightly above the surface of air flow passage 6.

A flow controlling needle 14 having a tapered flow controlling section 22 is reciprocally received within main fuel jet 12. Needle 14 has a substantially cylindrical upper end 24 with a plurality of height adjustment grooves 26. A spring washer or clip 28 is received in one of these grooves 26. See FIG. 4.

Needle 14 extends downwardly from a reciprocal slide 30 that is contained in carburetor 2 with clip 28 resting on an abutment 32 within slide 30. See FIG. 1. When so assembled, needle 14 moves vertically up and down with slide 30. As slide 30 rises, abutment 32 pushes up on clip 28 carrying needle 14 along with it. As slide 30 falls, abutment 32 falls away from clip 28 and gravity, along with a spring force if need be, causes needle 14 to fall back down with slide 30. Carburetors having a needle 14 mounted in a reciprocal slide 30, with needle 14 controlling flow through a main fuel jet 12, are well known in the art.

Figure 4:
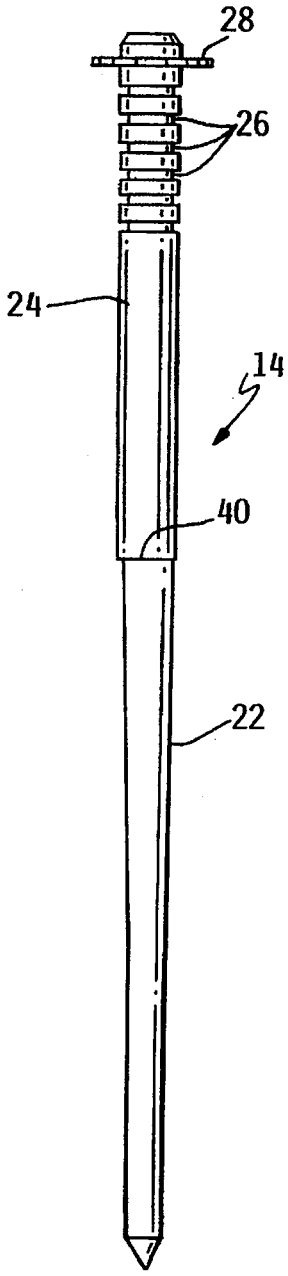
FIG. 4 is a side elevational view of the needle used in conjunction with the main fuel jet, particularly illustrating the stepped portion of the needle located intermediate its upper and lower ends.

Grooves 26 on the upper end of needle 14 allow the relative positions of needle 14 and slide 30 to be vertically adjusted to thereby adjust the relative positioning of needle 14 in main fuel jet 12. As shown in FIG. 4, when clip 28 is in the upper groove 26, needle 14 will extend out of slide 30 the farthest. Conversely, if clip 28 were to be repositioned into the bottom groove 26, needle 14 would not extend as far out of slide 30. These grooves 26 thus help adjust the positioning of needle 14 within a particular main fuel jet 12 of a particular carburetor 2 and help make a single needle 14 usable with different carburetors in which the slide/main fuel jet configurations are different.

In any event, main fuel jet 12 will have a minimum flow condition, which is usually a condition of zero or a very small fuel flow, when slide 30 is in its lowest position which will be referred to herein as the minimum fuel flow position of needle 14. In this minimum fuel flow position, needle 14 will extend into main fuel jet 12 a maximum amount to set the fuel flow through jet 12 to a preselected minimum value. It is desired that no additional fuel wick or travel up along needle 14 when needle 14 is in its minimum fuel flow position. If that occurs, the air/fuel mixture at idle or low speed conditions, in which the fuel is primarily supplied by another fuel jet (not shown) called the slow jet, becomes too rich for maximum performance.

As noted previously, the height of needle 14 within slide 30 can be adjusted using grooves 26 to help the operator adjust the minimum fuel flow controlled by needle 14. Thus, needle 14 can have various adjusted positions within slide 30 that can be selected by the operator. However, once a particular groove 26 has been chosen for use by the operator and clip 28 is placed in that groove 26, the height of needle 14 is then fixed relative to slide 30. Thereafter, the height of needle 14 varies during operation of carburetor 2 only through the up and down movement of slide 30, which occurs under the influence of some throttle linkage or by an increased volume of air passing through air flow passage 6 caused by opening throttle plate 10. The minimum fuel flow position of needle 14 referred to above is an operational position achieved during the operation of carburetor 2, normally when slide 30 is in its lowest position relative to fuel jet 12, and is not meant to refer to the various adjusted positions of needle 14 that are made possible using grooves 26.

This invention relates to the placement of a substantially horizontal stepped or shouldered portion 40 on needle 14 intermediate its upper and lower ends. Stepped portion 40 is not great and is preferably in the range of from 0.006 to 0.010 inches, i.e. the outer diameter of needle 14 at stepped portion 40 is 0.006 to 0.010 inches greater than the outer diameter of needle 14 immediately below stepped portion 40. However, the placement of stepped portion 40 along the length of needle 14 is important. It is important that stepped portion 40 be located no higher than top surface 20 of main fuel jet 12, and preferably somewhat slightly below top surface 20, when needle 30 is in it minimum fuel flow position and main fuel jet 12 is placed in its minimum flow condition. This is shown in FIG. 2.

Figure 2:
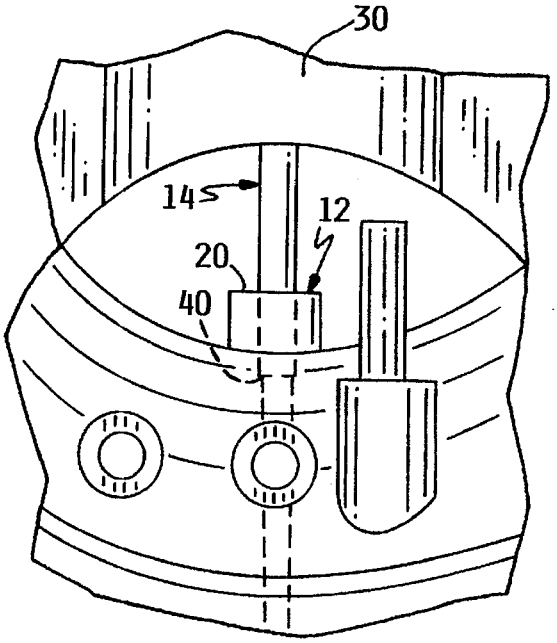
FIG. 2 is an enlarged front elevational view of the carburetor shown in FIG. 1, more particularly illustrating the needle received within the fuel jet in its minimum fuel flow position corresponding to a minimum fuel flow condition and with the stepped portion on the needle being located within the fuel flow passage of the fuel jet and beneath the top surface of the fuel jet.

Note that stepped portion 40 of needle 14 is well below top surface 20 of main fuel jet 12 as shown in FIG. 2 when the clip 28 is located in the uppermost groove 26. However, even if clip 28 is located in its lowest groove 26, stepped portion 40 would still be located at slightly below top surface 20 of main fuel jet 12. Thus, needle 14 is configured so that stepped portion 40 is preferably within main fuel jet 12 regardless of which groove 26 has been used when setting up needle 14.

The Applicant has discovered that the addition of stepped portion 40 to needle 14 prevents unwanted or undesirable fuel from wicking or traveling up the length of needle 14 when main fuel jet 12 is supposed to be in its minimum flow condition. The Applicant has observed such unwanted fuel trying to flow up along needle 14 in this condition. However, when such unwanted fuel hits stepped portion 40 of needle 14, the unwanted fuel stops and remains within main fuel jet 12. The unwanted fuel never leaves main fuel jet 12 but is retained within main fuel jet 12 by stepped portion 40 on needle 14. Thus, the air/fuel mixture is not unduly enriched when main fuel jet 12 is in its minimum flow condition.

Figure 3:
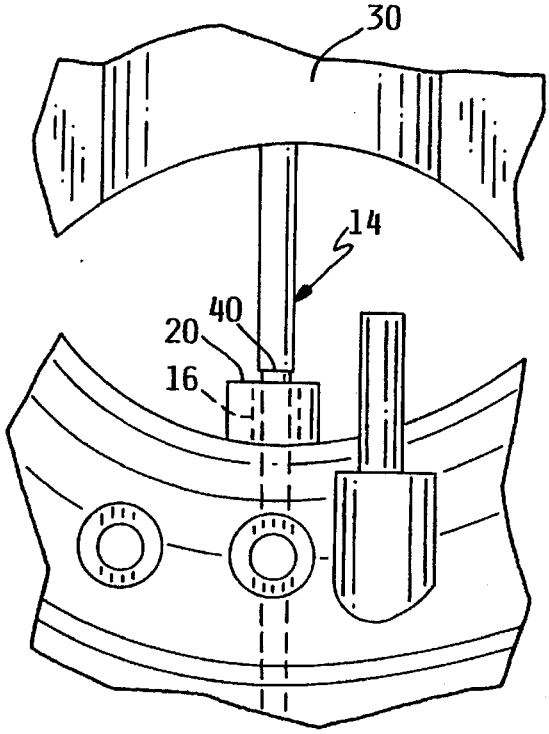
FIG. 3 is an enlarged front elevational view similar to that of FIG. 2, but showing the needle raised by the slide to a higher position in which fuel is allowed to flow out of the main fuel jet around the needle and with the stepped portion having been moved upwardly outside of the main fuel jet.

The Applicant has further discovered that the problem of unwanted fuel traveling up along needle 14 seems to be one in which the unwanted fuel travels up along the back of needle 14 taken with respect to the direction of air flow within air flow passage 6. For example, referring to FIGS. 2 and 3, the front of needle 14 is seen, but when fuel wicks it tends to travel up along the back of needle 14 with the back of needle 14 being hidden in FIGS. 2 and 3.

Stepped portion 40 on main fuel jet 12 is preferably manufactured as a complete 360° step or shoulder extending completely around the circumference of needle 14. If stepped portion 40 is manufactured as a complete 360° step or shoulder, it ensures that stepped portion 40 or some portion thereof is positioned along the back of needle 14 regardless of how needle 14 is dropped into slide 30. Thus, no special care need be taken to orient needle 14 in a particular way when dropping needle 14 down through slide 30. However, it would be possible to provide less than a complete 360° step or shoulder on needle 14, e.g. a step or shoulder of 120°–180°, as long as such step or shoulder is located on the back of needle 14 when needle 14 is assembled to slide 30. In this case, it might be desirable to key needle 14 to slide 30 so that needle 14 could be dropped down into slide 30 only in that orientation in which stepped portion 40, albeit with a partial step or shoulder, is properly oriented along the back of needle 14.

The use of stepped portion 40 on needle 14, regardless of its circumferential extent, simply prevents unwanted fuel from wicking or traveling up along needle 14 in the minimum flow condition of main fuel jet 12. Thus, the air/fuel mixture does not become too rich. Operational performance of the engine at idle or low speed conditions is thus enhanced. Nonetheless, as the engine goes into mid range or high speed operation, and slide 30 rises to cause needle 14 to rise relative to main fuel jet 12, stepped portion 40 will quickly rise up out of main fuel jet 12 and have no further effect. Then, the fuel flow through main jet 12 is controlled between tapered section 22 of needle 14 and main fuel jet 12 as it always has been, with more fuel flowing between the two as needle 14 rises up out of main fuel jet 12.

Various modifications of this invention will be apparent to those skilled in the art. For example, stepped portion 40 has been shown as being integrally manufactured as part of needle 14. However, a stepped portion 40 could be placed on needle 14 in other ways. For example, a separate sleeve or washer could be dropped down around a stepless needle 14 with the sleeve or washer then being rigidly fixed to the needle such that the lower end of the sleeve or the lower face of the washer forms the step. Thus, the scope of the present invention is to be limited only by the appended claims.

I claim:

1. A fuel discharge assembly for an engine, which comprises:

(a) a slow fuel jet for supplying fuel to an air flow passage at idle or at low speeds of the engine;

(b) a main fuel jet for supplying fuel to the air flow passage at midrange or high speeds of the engine, wherein the main fuel jet has a fuel flow passage that is operatively connected to the air flow passage for conducting fuel from a supply of fuel through the main fuel jet and into the air flow passage;

(c) a flow controlling needle reciprocally mounted in the fuel flow passage of the main fuel jet to control the amount of fuel that flows therein, wherein the flow controlling needle is movable relative to the main fuel jet to increase the fuel flow through the fuel flow passage of the main fuel jet; and (d) a stepped portion on the flow controlling needle circumferentially extending at least partially around the needle, the stepped portion being positioned on the needle such that it is located within the fuel flow passage of the main fuel jet in at least one position of the needle.

2. A fuel discharge assembly for an engine, which comprises:

(a) a slow fuel jet for supplying fuel to an air flow passage at idle or at low speeds of the engine;

(b) a main fuel jet for supplying fuel to the air flow passage at midrange or high speeds of the engine, wherein the main fuel jet has a top surface and a fuel flow passage that is operatively connected to the air flow passage for conducting fuel from a supply of fuel through the main fuel jet, past the top surface of the main fuel jet, and into the air flow passage;

(c) a flow controlling needle reciprocally mounted in the fuel flow passage of the main fuel jet to control the amount of fuel that flows therein, wherein the flow controlling needle has a minimum fuel flow position which represents a minimum fuel flow condition for the main fuel jet at idle or low speeds of the engine, and wherein the flow controlling needle can be vertically raised from its minimum fuel flow position relative to the main fuel jet to increase the fuel flow through the main fuel jet at midrange or high speeds of the engine; and (d) a stepped portion on the flow controlling needle extending at least partially around the needle's circumference, the stepped portion being positioned on the needle's length such that it is located no higher than the top surface of the main fuel jet when the needle is in its minimum fuel flow position, thereby to prevent unwanted wicking of fuel along the needle and into the air flow passage during operation of the engine at idle or low speeds.

3. The assembly of claim 2, wherein the stepped portion is located at least over the back of the needle taken with respect to the direction of air flow through the air flow passage.

4. The assembly of claim 2, wherein the stepped portion on the needle is substantially horizontal.

5. The assembly of claim 2, wherein the stepped portion circumferentially extends substantially 360° around the needle's circumference.

6. The assembly of claim 2, wherein the stepped portion is positioned on the needle such that is located below the top surface of the main fuel jet when the needle is in its minimum fuel flow position.

7. The assembly of claim 2, wherein the stepped portion has a diameter which is 0.006 to 0.010 inches greater than an outer diameter of a portion of the needle immediately below the stepped portion.

8. The assembly of claim 7, wherein the needle below the stepped portion has an inwardly tapered configuration.

9. The assembly of claim 2, wherein the needle below the stepped portion has an inwardly tapered configuration.

10. An improved flow controlling needle suited for use with a fuel jet for supplying fuel to an air flow passage, wherein the fuel jet has a top surface and a fuel flow passage that is operatively connected to the air flow passage for conducting fuel from a supply of fuel through the fuel jet, past the top surface of the fuel jet, and into the air flow passage, the flow controlling needle being reciprocally mounted in the fuel flow passage of the fuel jet to control the amount of fuel that flows therein, the flow controlling needle having a minimum fuel flow position, wherein the flow controlling needle can be vertically raised from its minimum fuel flow position relative to the fuel jet to increase the fuel flow through the fuel jet, and wherein the improvement relates to the needle and comprises:

a needle having a stepped portion extending at least partially around the needle's circumference, the stepped portion being positioned on the needle's length such that it is located no higher than the top surface of the fuel jet when the needle is in its minimum fuel flow position relative to the fuel jet, wherein the stepped portion has a diameter which is 0.006 to 0.010 inches greater than an outer diameter of a portion of the needle immediately below the stepped portion.

11. The flow controlling needle of claim 10, wherein the stepped portion is located at the junction between a tapered lower section of the needle and a substantially cylindrical upper end of the needle.

12. The flow controlling needle of claim 10, wherein the stepped portion circumferentially extends substantially 360° around the needle.

13. The flow controlling needle of claim 10, wherein the stepped portion is perpendicular to a longitudinal axis of the needle so as to be oriented substantially horizontally when the needle is oriented vertically.

14. An improved carburetor for use on an internal combustion engine, the carburetor having an airflow passage and fuel discharge means for admitting fuel into the airflow passage for mixing the fuel with air flowing in the airflow passage to form a fuel/air mixture to be supplied to the combustion chamber(s) of the engine, the fuel discharge means including a fuel discharge assembly having a slow fuel jet for supplying fuel to the air flow passage at idle or at low speeds of the engine and a main fuel jet for supplying fuel to the air flow passage at midrange or high speeds of the engine, wherein the main fuel jet comprises a hollow fuel jet and a flow controlling needle reciprocally received within the main fuel jet for controlling the amount of fuel flowing through the main fuel jet and into the air flow passage, wherein the improvement relates to the needle and comprises:

a needle having a stepped portion extending at least partially around the needle's circumference, the stepped portion being positioned on the needle's length such that it is located within the main fuel jet when the needle is in its minimum fuel flow position relative to the main fuel jet.

* * * * *